US006213340B1

(12) United States Patent
Gehant

(10) Patent No.: US 6,213,340 B1
(45) Date of Patent: Apr. 10, 2001

(54) ICE BUCKET FOR BOTTLES, ESPECIALLY A CHAMPAGNE BUCKET

(75) Inventor: Andre Maurice Gilbert Gehant, Faucogney (FR)

(73) Assignee: SEB S.A. (FR)

( * ) Notice: Subject to any disclaimer, the term of this patent is extended or adjusted under 35 U.S.C. 154(b) by 0 days.

(21) Appl. No.: 09/237,910

(22) Filed: Jan. 27, 1999

(30) Foreign Application Priority Data

Jan. 27, 1998 (FR) ..... 98 01106

(51) Int. Cl.[7] ..... B65D 25/00
(52) U.S. Cl. ..... 220/752; 220/770; 220/775
(58) Field of Search ..... 220/752, 760, 220/764, 770, 775

(56) References Cited

U.S. PATENT DOCUMENTS 631,845 * 8/1899 Butter et al. ..... 220/770
670,618 * 3/1901 Lewis ..... 220/775
746,733 * 12/1903 McDonald ..... 220/775
1,728,257 * 9/1929 Seigh ..... 220/775
2,009,680 * 7/1935 Rollason ..... 220/775
2,604,579 7/1952 Deneboudes .
4,534,391 8/1985 Ventimiglia et al. .

FOREIGN PATENT DOCUMENTS 2 639 530 1/1990 (FR) .

* cited by examiner

*Primary Examiner*—Steven Pollard
(74) *Attorney, Agent, or Firm*—Nixon & Vanderhye P.C.

(57) ABSTRACT

Ice bucket for bottles or carafes, particularly champagne buckets, includes a bucket wall, a housing having an interior region which is attached to an area of the bucket wall, and an essentially flat bucket attached to the housing so as to cover the interior region thereof. The housing itself preferably includes an installation interface that is distinct from, but installed against, the bucket wall. The bucket marker may thus be attached to the housing in order to cover flaws resulting from the installation of the installation interface against the bucket wall.

8 Claims, 3 Drawing Sheets

ICE BUCKET FOR BOTTLES, ESPECIALLY A CHAMPAGNE BUCKET

This invention pertains to the area of ice buckets or receptacles for bottles or carafes, such as champagne buckets, which comprise walls and are able to receive a means of marking the bucket, for example a label.

This invention pertains to an ice bucket or receptacle for bottles or carafes, and in particular a champagne bucket, that comprises walls and at least one area that is specially designed to be able to receive a means of marking the bucket.

Ice buckets for bottles or carafes are well known and widely used to display bottles of wine and to keep them at proper serving temperature, either for bottles of white wine or sparkling wine or bottles of champagne, for example.

The ice buckets that are currently known are generally made of metal, such as stainless steel or aluminum, and come in the form of receptacles of various shapes, generally like a cylinder or truncated cone, to hold the bottle to be cooled and the volume of ice required to ensure the cooling function.

The known buckets comprise walls and a means of gripping, which generally consists of a pair of handles that are attached by known and conventional means to the walls, by screwing, riveting, soldering, or even by gluing.

Since these are articles that are mainly to be used on occasions of a festive nature, particularly in the case of champagne buckets, the majority of champagne buckets are equipped with means of marking the bucket that display an inscription and/or a design or a logo that is intended to personalize the bucket and to impart to it an additional aesthetic quality, which may optionally be related to or associated with the kind and brand of bottle to be cooled.

According to a first technique, it is known to affix the marking means directly to the walls of the ice bucket by the classic technique of engraving. Said technique requires special tools and can be executed only at the sites where the buckets are manufactured. Use of the technique of direct engraving thus requires a considerable investment in engraving equipment since the operation itself has to be integrated into the actual manufacturing process.

Overall, these techniques thus prove to be relatively costly in terms of both equipment and time. Moreover, the fact that it is necessary to carry out the marking operation right at the location where the device is manufactured makes it impossible to retain the option of personalizing the ice bucket according to the flow of orders or based on specific customer requirements since this operation has to be integrated into the manufacturing process.

It is also already known to make use of indirect marking techniques including, in particular, the technique of silk-screen printing, whereby said techniques consist of attaching by, for example, gluing a marking means such as a label directly to the ice bucket. This is known from, for example, documents FR-2 639 530 and US-A-4 534 391. This kind of technique may also require the use of special tools owing, in particular, to the need to ensure the preparation of the surface of the area to which the label is to be affixed. Most of the time, the preparation of the surface is done by creating, by simply molding the surface, a specially designed area in the wall of the bucket so that it is able to receive a marking label.

In addition to the need to use specific tools, the drawbacks of this kind of indirect marking technique lie in the proper behavior of the label which, over the long term, may tend to peel and/or become deformed. With respect to decorative-type labels that are intended to improve the appearance of the ice bucket or at least to coordinate with it, the use of this kind of technique proves to be less than appropriate to the goal here. In addition, as in the case of direct marking techniques, the affixing of an external label must necessarily be done at the locations of manufacture and consequently cannot be adapted to the evolving requirements as regards the personalization of the bucket and responsiveness to the constraints of orders or the need to rotate stocks.

The object of this invention is therefore to propose an approach to the marking of a ice bucket that does not have the drawbacks mentioned above and makes it possible to obtain an ice bucket that is able to receive a means of marking the bucket by means of an operation that is especially easy to carry out, does not require any particular investment, tends to enhance the appearance of the bucket, and promotes aesthetic harmony with the bottle to be cooled.

Another object of the invention is to propose a new ice bucket in which the operation of attaching the marking means is carried out in a particularly quick way without using specific tools and does not need to be executed at the location where the bucket is manufactured.

Another object of the invention is to propose a means of marking the bucket that is able to reduce and/or eliminate defects of manufacture or installation that may develop during the creation of the bucket.

Another object of the invention is to propose a new ice bucket in which the marking means is attached to the bucket in a particularly secure way and is not likely to deform or change over time or as the bucket undergoes usage.

Another object of the invention is to propose a new use for a bottle plug cap, and especially a champagne bottle plug cap.

The objects at which the invention is aimed are achieved by means of an ice bucket for bottles or carafes, especially a champagne bucket, that comprises walls and at least one area that is especially designed to be able to receive a means of marking the bucket, whereby said area is formed by a housing, which is characterized in that the marking means is formed by an essentially flat part and has a certain degree of rigidity so that it can be attached in or to the housing and can cover up at least its bottom.

The objects at which the invention is aimed are also achieved by means of a champagne bottle plug cap that is designed to be attached to an ice bucket according to the invention.

Other details and advantages of the invention are described more specifically in light of the description and the illustrative examples found below, which are given by way of non-limiting examples, where:

The ice bucket for bottles or carafes according to the invention, examples of which are shown in FIGS. 1–5, consists of a receptacle 1 that is essentially a truncated cone and comprises walls 2 and a bottom 3, whereby at its top receptacle 1 has an opening 4 for the introduction of the bottle or carafe to be cooled, as well as means required for cooling, such as ice, for example.

In the variant embodiment shown in FIGS. 1–4, receptacle 1 is made of a metal, which can be, e.g., stainless steel or aluminum.

Figure 2:
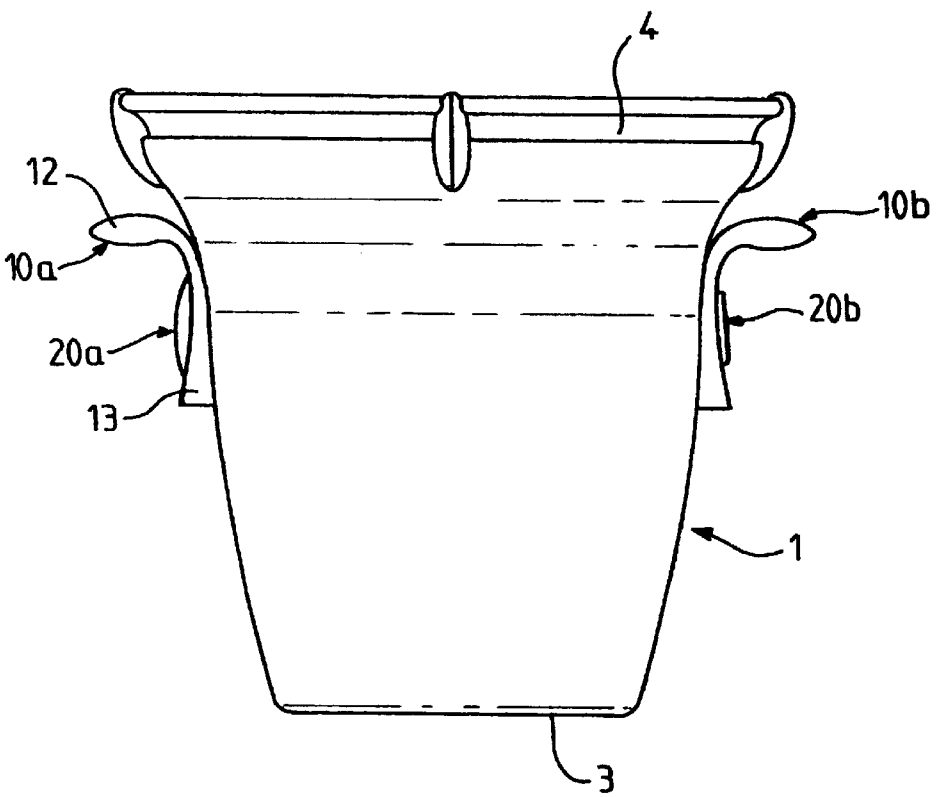
FIG. 2 shows a side view of the bucket according to the invention shown in FIG. 1, where the two types of marking caps according to the invention are installed.
Figure 1:
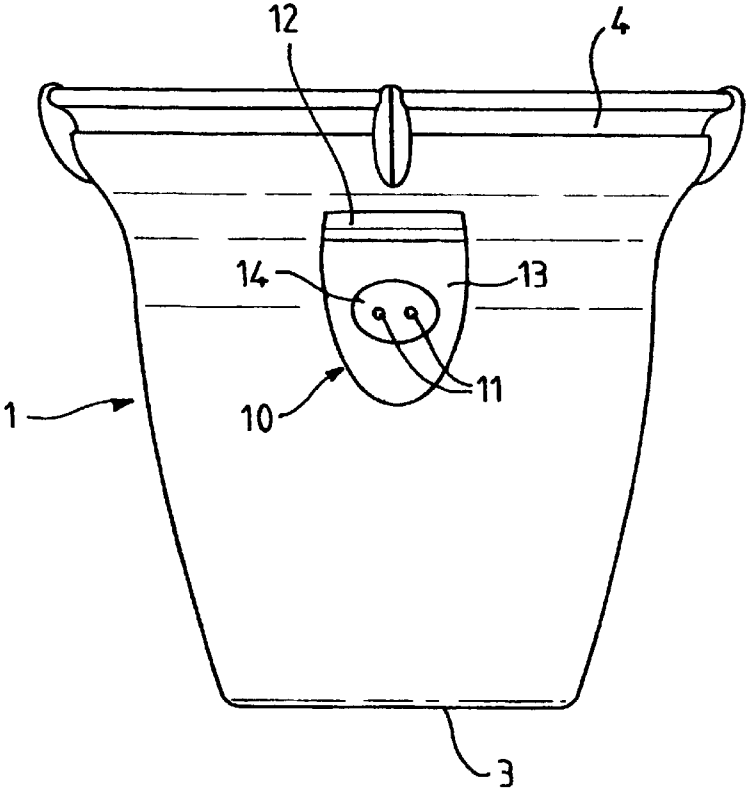
FIG. 1 shows a plan view and front view of an ice bucket according to the invention that comprises a marking cap that is attached in or to a housing which is made in a handle of the bucket.
Figure 4:
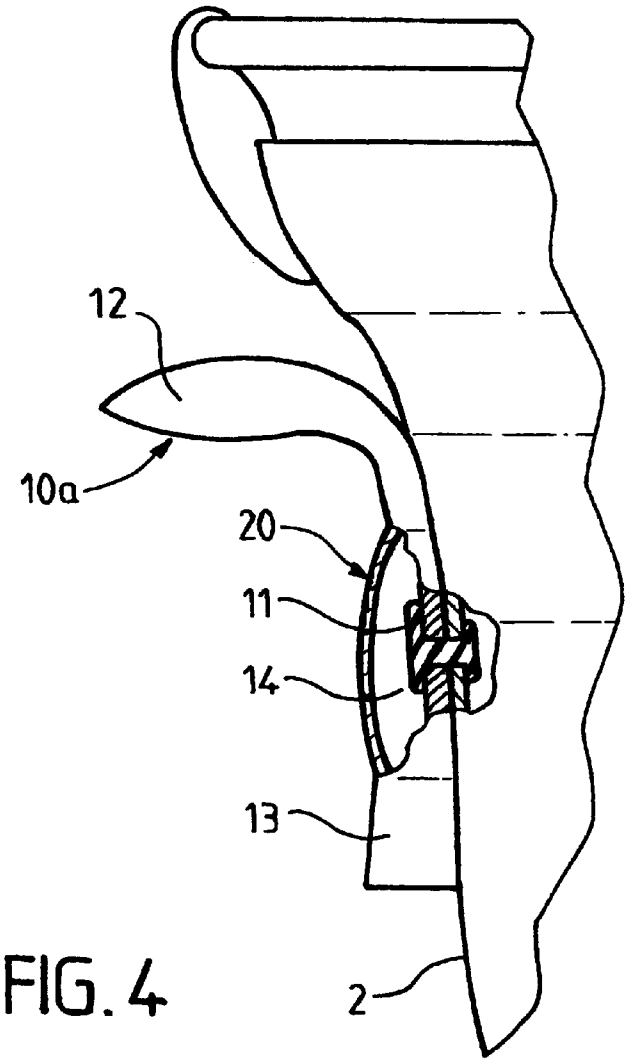
FIG. 4 shows a partial cutaway view of a detail of the installation of a cap according to the invention in a housing of an installation interface.

In the variant embodiment shown in FIGS. 1, 2, and 4, the ice bucket according to the invention is equipped with an installation interface that is separate from walls 2 and is formed by least one device 10, e.g., a metal device that is attached to walls 2 with the aid of attachment means 11. In the variant embodiment shown in FIGS. 1, 2, and 4, installation interface 10 is formed by two handles 10*a*, 10*b* which in their upper parts have gripping handles 12 that are extended downward, considering the installation position shown in the figures, by attachment tongues 13. Each installation interface 10 includes a non-through housing 14 that is located in the thick part of each attachment tongue 13. As shown in FIG. 1, housing 14 can be in the shape of a hemisphere or any other shape: round, square, rectangular, etc..

Attachment means 11 can be screws or rivets or similar means, whereby said means are thus arranged at the bottom of each housing 14 and penetrate walls 2 by means of holes, not shown in the figures. In the example shown in FIGS. 1–4, attachment means 11 are formed by rivets, whose heads are forced into housing 14. Clearly, the opposite approach could also be implemented.

According to the invention, the bucket is able to receive a marking means that comes in the form of a marking part 20 that is essentially flat and has a certain degree of rigidity or, in any case, is rigid enough to be attached in or to housing 14 and to close said housing.

According to a preferred embodiment of the invention, part 20 is composed of a bottle plug cap, preferably a champagne bottle plug cap, that is attached in or to each housing 14. According to the invention, caps 20 that are used (FIG. 4) are conventional caps, preferably made of metal or plastic such as those commonly used to fit into and onto the tops of champagne bottle plugs. Caps 20 come in the form of flat parts that are either of even or uneven thickness, such as cap 20*b* of handle 10*b*, or bulge outward, such as those shown in connection with handle 10*a*. In the case of caps 20, which are of variable thickness and are convex, cap 20 will advantageously provide a magnifying-glass effect, thereby improving the legibility of any inscriptions that may be present. In the description given below, reference will be made more particularly to a marking cap in the form of a marking part 20, without thereby limiting the marking part to said particular embodiment.

The shape of each cap 20 is mated to that of housing 14 that is associated with said cap so as to be able to cover up said housing 14 or at least its bottom, as well as the flaws that result from the creation or installation of interface 10 on walls 2.

Also according to the invention, each cap 20 may be slightly smaller than housing 14 so that it can be attached in housing 14 by clipping, as shown in FIG. 4. Caps 20 may also be slightly larger than housing 14 so that they can be attached to the housing and secured by, e.g., gluing to the ring-shaped outer edge of each housing 14. In all cases, each cap 20 makes it possible, by the way it is installed in or on housing 14, to close housing 14 and to cover attachment means 11.

In this vein, each cap 20 makes it possible to impart an aesthetic quality to the bucket as a whole by covering up the unappealing appearance of attachment means 11, as well as any deterioration spots that are likely to develop during installation. In addition to attaching, by simple clipping or gluing or other similar means, a marking cap or part 20 that may or may not be equipped with a distinctive symbol, the invention makes it easy and quick to personalize a champagne bucket at points other than during the bucket production cycle. This makes it possible to adapt quickly to large and varied demand and to ensure optimum management of stocks of unmarked buckets. Finally, it is of some interest to note that this also makes it possible to coordinate and match cap 20 and any distinctive symbol that it may bear to the marks and distinctive symbols that are likely to be affixed to the bottle that is specifically intended to be used in combination with the bucket under normal circumstances.

Figure 3:
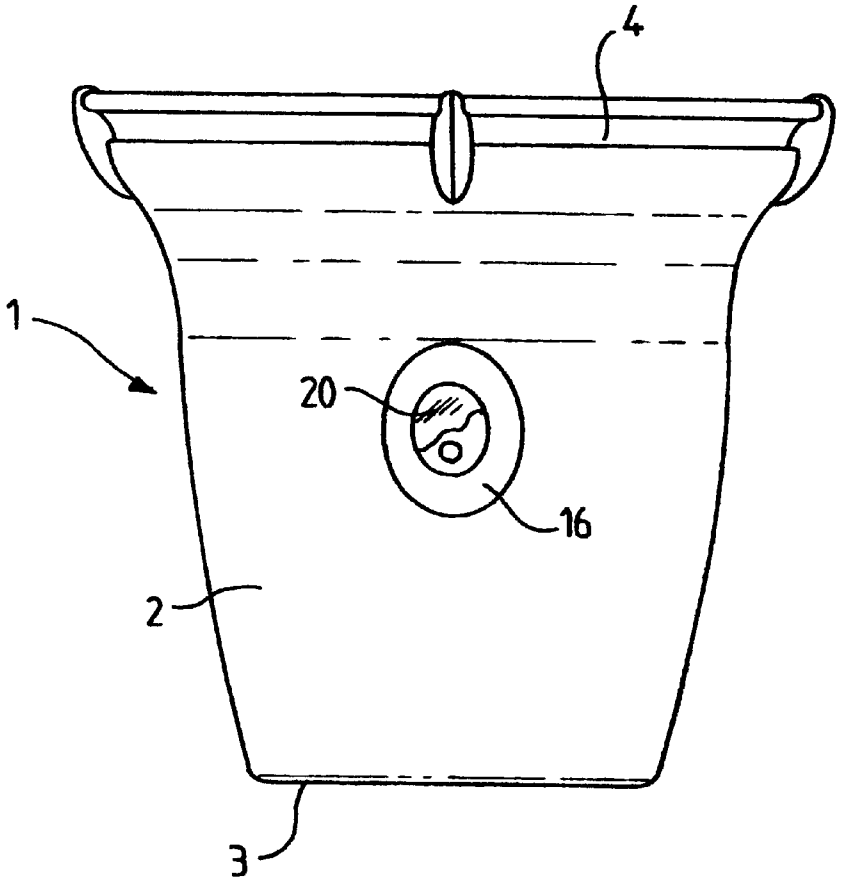
FIG. 3 shows a front view of a variant of an installation interface according to the invention.

As a variant embodiment as shown in FIG. 3, installation interface 10 may be created in the form of a medallion 16 which is, e.g., round or essentially round and comprises essentially at its center a housing 14 to which cap 20 is attached as described above. As in the previously described embodiment, attachment means 11 are arranged at the bottom of housing 14 and are designed to be covered by cap 20.

Figure 6:
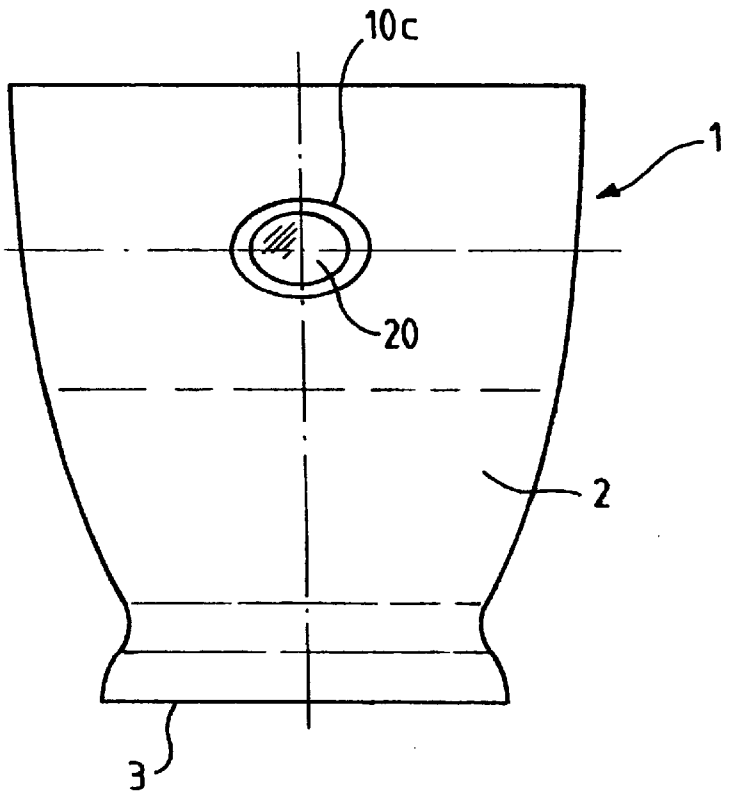
FIG. 6 shows a side view according to FIG. 5 of a plastic ice bucket that is equipped with a marking means according to the invention.
Figure 5:
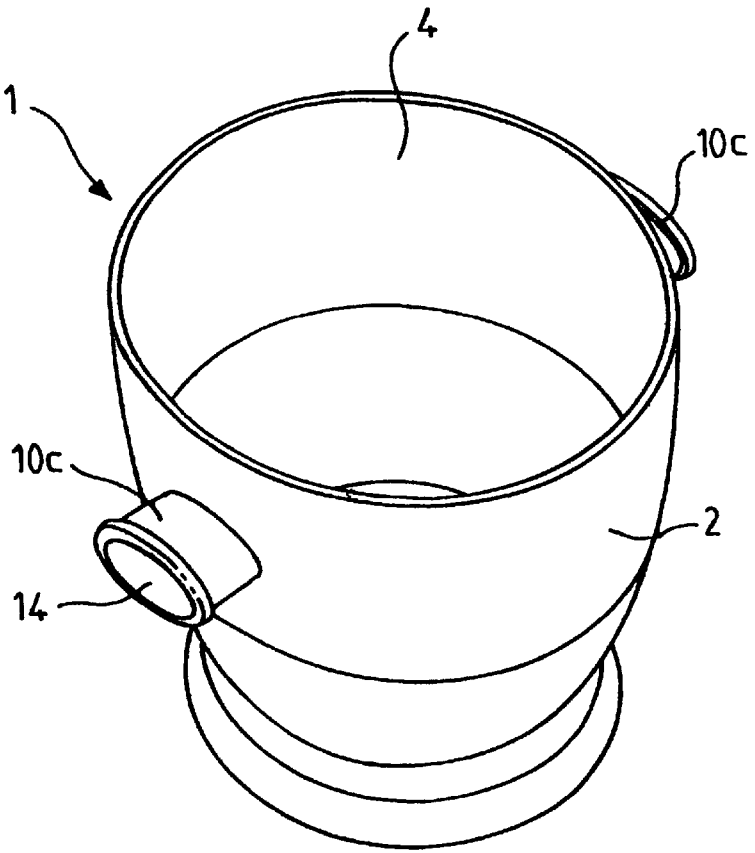
FIG. 5 shows a perspective view of a variant embodiment of the invention that pertains to an ice bucket made of plastic.

The embodiment shown in FIGS. 5 and 6 is distinguished from the preceding embodiments only by the fact that a plastic is used as the material for the bucket and for walls 2 that comprise it. In this kind of embodiment, receptacle 1 is molded, for example by injecting polypropylene into a mold, whereby installation interfaces 10 are then formed by handles 10*c* that are produced by the actual molding of the bucket and each include an internal through hole that forms housing 14, which is also produced by the molding operation. According to the invention, the unappealing appearance that results from the presence of a hole or housing 14 in each handle 10*c* and any defects associated with, for example, the demolding operation can be covered up by attaching a cap 20 in or on housing 14. As in the previous embodiment, cap 20 can be inserted in housing 14 by, for example, clipping or can be glued with the aid of, for example, a layer of resin on the outer edge of a collar that surrounds housing 14.

The use of marking caps that are attached in a housing 14 that is made in an installation interface 10 makes it possible to provide for simple and discrete marking of an ice bucket, while at the same time avoiding the constraints known from the prior art, which required marking at the factory and the use of specific tools. The speed with which the marking is done is also especially well adapted to the economic constraints of the market, which call for personalizing each bucket and rapidly responding to demand. Finally, this kind of marking method proves to be especially well adapted to the particular "high-end" range of ice buckets, and especially champagne buckets.

What is claimed is:

1. Ice bucket for bottles or carafes, particularly champagne buckets, comprising a bucket wall, a marking device connected to an area of said bucket wall, said marking device including an upper handle region which extends outwardly from said bucket wall, and a lower attachment tongue region depending from said upper handle region so as to be positioned adiacent to said area of said bucket wall, said tongue region having a recessed interior region which defines at least one through hole with said adjacent area of said bucket wall, and wherein said marking device is immovably attached to said exterior region of said bucket wall by an attachment means positioned in said at least one through hole, and wherein said marking device includes an essentially flat bucket marker attached to said attachment tongue region so as to cover said recessed interior region thereof.

2. Bucket according to claim 1, wherein said bucket marker is formed by a bottle plug cap.

3. Bucket according to claim 1, wherein said bucket marker is made of metal or plastic.

4. Bucket according to claim 1, wherein said bucket marker is attached in housing by clipping.

5. Bucket according to claim 1, wherein said bucket marker is glued to housing.

6. Bucket according to claim 1, wherein said bucket marker is concave in order to provide a magnifying-glass effect.

7. Bucket according to claim 2, wherein the bucket marker is a champagne bottle plug cap.

8. Bucket according to claim 1, wherein the attachment device includes screws or rivets.

* * * * *